United States Patent [19]

Farish et al.

[11] Patent Number: 4,811,880

[45] Date of Patent: Mar. 14, 1989

[54] CONTINUOUS WEB HANDLING APPARATUS AND METHOD OF SEPARATING WEB SECTIONS

[75] Inventors: H. Greggs Farish, Pointe Claire; Ross Hoge, Westmount, both of Canada

[73] Assignee: M-A-N Ashton Inc., Montreal, Canada

[21] Appl. No.: 121,810

[22] Filed: Nov. 17, 1987

[51] Int. Cl.[4] ..... B65H 20/00; B65H 23/32; B65H 35/02

[52] U.S. Cl. ..... 226/197; 226/15; 226/189; 242/56.5

[58] Field of Search ..... 226/15–23, 226/109, 189, 197; 242/56.5

[56] References Cited

U.S. PATENT DOCUMENTS 3,103,843 9/1963 Schoenberger, Jr. ..... 242/56.5 X
3,966,105 6/1976 Curran ..... 226/21

FOREIGN PATENT DOCUMENTS 836437 3/1952 Fed. Rep. of Germany ..... 242/56.5
656009 8/1951 United Kingdom ..... 226/197

*Primary Examiner*—Thomas R. Hannon
*Attorney, Agent, or Firm*—Samuel Meerkreebs

[57] ABSTRACT

In a business forms press and method wherein a wide, continuous web of paper is separated into a plurality of business forms width sections, a web separating unit provides pairs of bars for each web section, arranging the pairs of bars so that the axis of these bars is at an obtuse angle to the longitudinal direction of the press and at an obtuse angle to the path of the webs, arranging the pairs of bars so that their distance between the axis thereof and the angle of the plane through the axis of the respective pair of bars with the plane of the web entering the bars is such to provide lateral displacements of the different web sections from each other.

7 Claims, 4 Drawing Sheets

CONTINUOUS WEB HANDLING APPARATUS AND METHOD OF SEPARATING WEB SECTIONS

BACKGROUND OF THE INVENTION

1. Field of the Invention

The present invention relates to web handling devices, and more particularly, to an apparatus for laterally displacing web sections after the sections have been cut from a single web.

2. Description of the Prior Art

In order to increase productivity in business forms presses, it is known to pass a wide continuous web through a wide business form press and then to cut and separate longitudinal sections of the web and to fold and otherwise package the separate web sections, which are at standard widths for business forms.

In a business forms press, a web is unwound from a roll, passed under tension through successive printing units or towers, and then through processing units, such as for numbering, file hole punching, line hole punching, cross perforation, etc., and finally zigzag folding. All of these operations must be accurately registered. Passing a wide web through the press which ultimately can be separated into three or four web sections, each of which represents a standard width business forms press, has obvious advantages.

The separation of the wide web preferably occurs after the processing units, immediately preceding the zigzag folding of the web sections. However, after the web has been cut longitudinally to form the web sections, the edges of the web sections are adjacent each other and must be separated in some manner in order to allow for ease of operation. Presently, it has been known to stagger such folders longitudinally in order to provide space for such equipment. However, this increases the space requirements of the press.

Other solutions include slacking the tension in the webs and then separating the webs, reapplying tension, and then folding the individual webs as suggested in Fulk's U.S. Pat. Nos. 3,596,899, issued Aug. 3, 1971, and reissued Oct. 3, 1978 as Re. 29,794, and 4,068,973, issued Jan. 17, 1978. Although Fulk refers to superimposed webs, it is obvious that the same technique could apply to a wide web for separating the resultant web sections. However, the apparatus required for slacking and retensioning the webs renders this alternative to be too expensive.

SUMMARY OF THE INVENTION

It is an aim of the present invention to provide an inexpensive and space-saving alternative to the above-described methods of separating web sections.

In a construction and method according to the present invention, there is provided an apparatus for separating a plurality of webs to provide a predetermined distance between the edges of the webs. The apparatus and method include a series of rolls and bars over which a first web passes and a second series of rolls and bars over which a second web passes and of which it is required that the second web be displaced a predetermined lateral distance from the first web. The second series of rolls and bars include at least a pair of parallel bars, the axes of the parallel bars being at an obtuse angle to the longitudinal axis of the webs, whereby the second web will be caused to be displaced laterally from the first web.

In a more specific embodiment of the present invention, the distance of lateral displacement of the second web relative to the first web is a result of the angle of the axes of the pair of bars relative to the axis of the web, the segmental area of wrap or the degree of wrap of the web on the respective surfaces of the pair of bars, and the distance between the bars.

The web passes between the pair of bars in the sense that it wraps over one bar and under the other. The fact that the bars are parallel causes the longitudinal axes of the incoming and exiting webs to remain parallel. If the bars are at an obtuse angle to the axis of the web entering the bars, that is, an acute angle to the transverse axis of the web, the web will overwrap about a segment of one of the bars of the pair and exit the bar at an acute angle to the axis of the web. When the web underwraps the other of the parallel bars and exits the other parallel bar in a plane parallel to the plane of the web entering the pair of bars, it will assume a direction parallel but offset to the axis of the web entering the pair of bars.

If the distance between the bars is increased, the path traveled between the bars by the web at an angle to the axis of the web entering the bars will increase the lateral displacement of the web portions.

If the web is caused to wrap o the respective bars over a greater segment of the bars, the angle at which the web exits the one bar will be increased, thereby increasing the lateral displacement of the web as it exits the other of the pair of bars. The degree of overwrap will be varied by increasing or decreasing the angle of the plane of the axes of the pair of bars to the plane of the web entering the pair of bars which will respectively decrease or increase the segment of wrap of the web on the respective bars of the pair.

Thus, the distance of lateral displacement of the web exiting the other of the pair of bars is a direct result of the angle of the axes of the pair of bars to the axis of the web entering the bars; and if that angle is other than a right angle, a combination with one or both of the following factors:

1. the distance between the bars; and
2. the angle between the plane through the axes of the pair of bars with the plane of the web entering the pair of bars.

Thus, multiple longitudinal web sections can be displaced laterally relative to each other by providing a pair of bars for each web section to be displaced, with each pair of bars having different characteristics with respect to the above-described factors.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
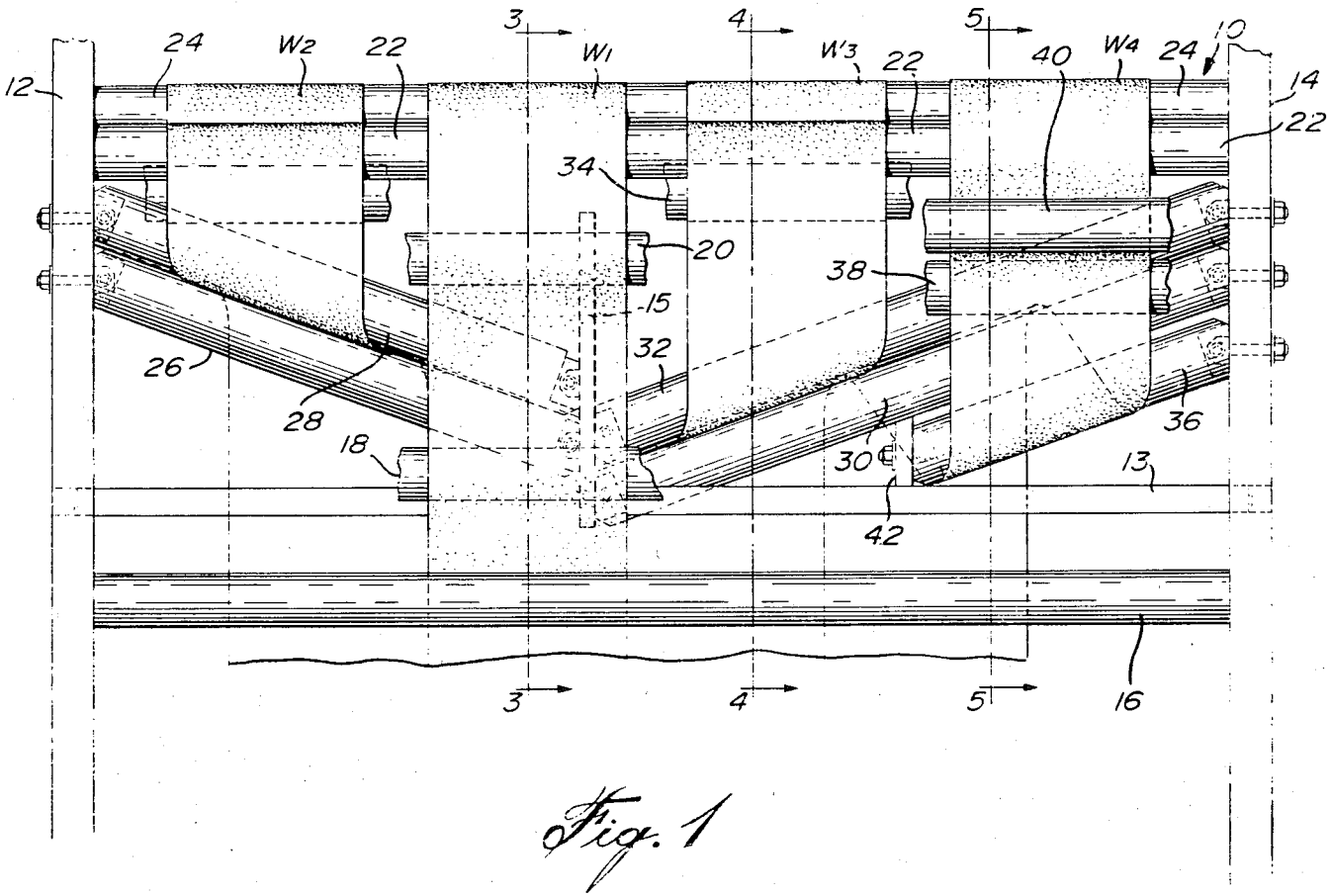
FIG. 1 is a fragmentary front elevation of the apparatus in accordance with the present invention.
Figure 2:
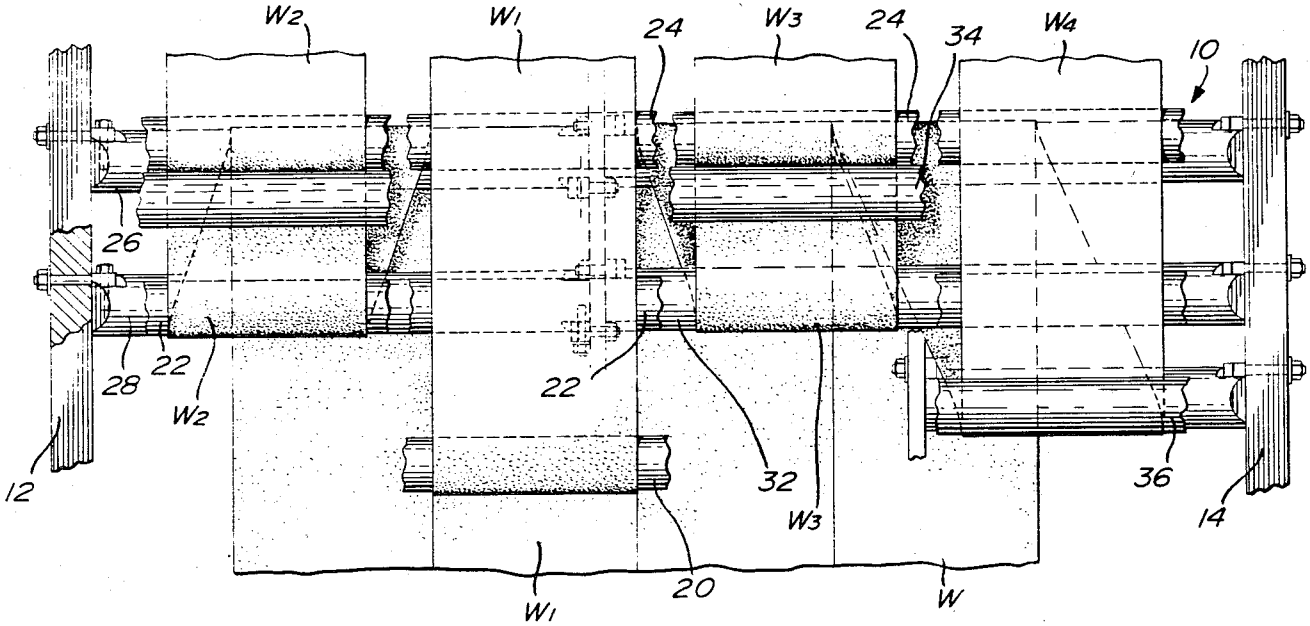
FIG. 2 is a fragmentary top elevation of the apparatus shown in FIG. 1.

Referring now to the drawings, an embodiment of the present invention is illustrated as including a unit of four web sections after they have been cut from a single wide web W. Each of the resulting web sections W1, W2, W3, and W4, cut from the single wide web W, are to be displaced by the processing unit 10 on a typical forms press having side frame members 12 and 14.

The processor 10 would be located immediately after the last processing station on the forms press but preceding the folding mechanism. This last processing station might be the cross perforation unit. Slitting wheels (not shown) would be provided in order to cut the web W into four equal web sections W1, W2, W3, and W4, with each web section being a standard width for a business form.

Figure 3:
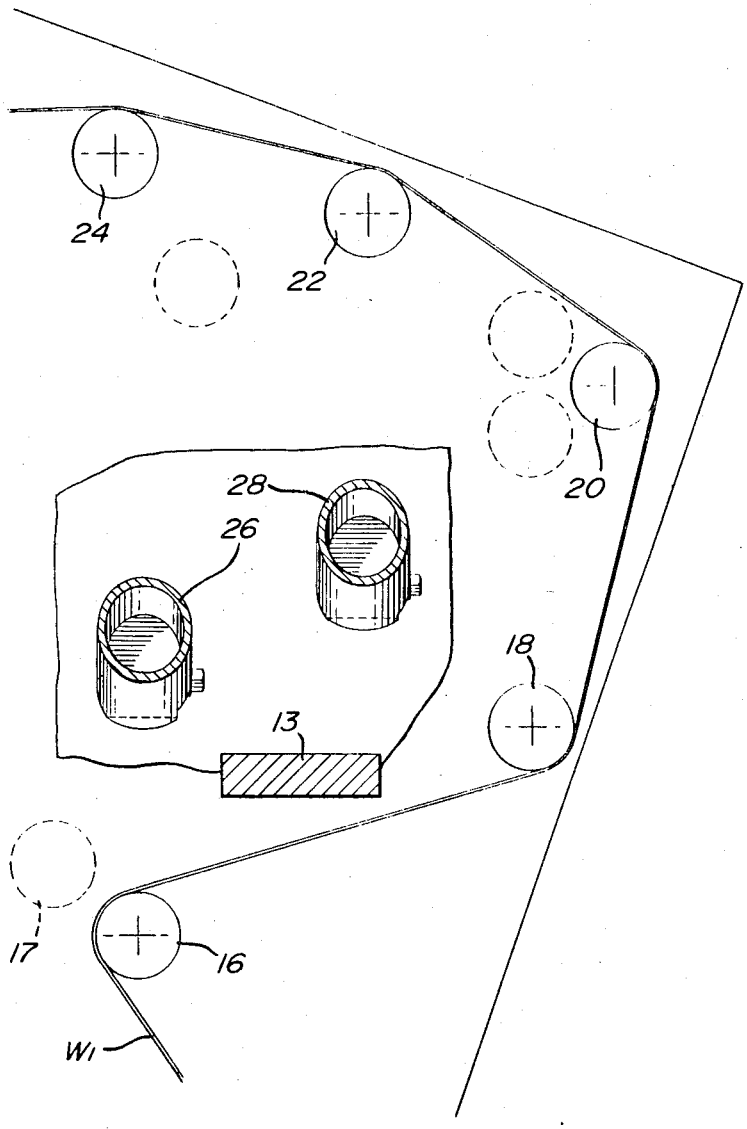
FIG. 3 is a vertical cross-section taken along line 3—3 of FIG. 1.

After the web W is slit, the edges of the respective web sections W1–W4 remain in close proximity to each other, as shown at the bottom portion of FIG. 1. In order to pass the resulting web sections to the folding mechanism, it is necessary to separate the web sections W1–W4 such that there is a space between each web of approximately 3 inches. This spacing is believed to be sufficient to properly handle the four web sections after they are folded In the embodiment illustrated in the drawings, web section W1 is considered the base web section from which the other web sections must be displaced. Accordingly, as shown in FIG. 3 of the drawings, web W1 merely passes over idler rollers 16, 18, 20, 22, and 24. All of these idler rollers 16, 18, 20, 22, and 24 are at right angles to the axis of the web W1, and thus the web W1 is maintained in a straight longitudinal path.

On the other hand, it will be necessary to displace webs W3 and W2 relative to W1. Since the displacement of web W2 is identical to web W3, only the apparatus relating to W3 will be described, keeping in mind that the bars 26 and 28 will have the same characteristics as the bars 30 and 32.

Figure 4:
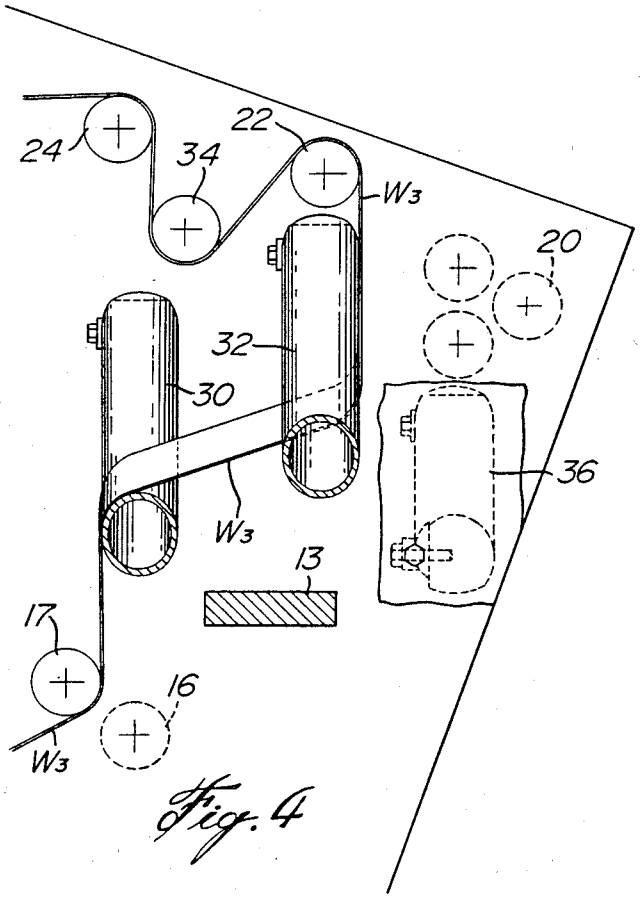
FIG. 4 is a vertical cross-section taken along line 4—4 of FIG. 1.

Referring now to FIGS. 1 and 4, bars 30 and 32 will be described. Bars 30 and 32 are in the form of cylindrical tubes extending between side frame 14 and intermediate frame member 15 which is mounted to cross beam 13. Bars 30 and 32 are provided with apertures at the surface thereof communicating with the center of the tube to allow air under pressure to pass through the apertures and form an air cushion for the web W3 as it passes over bar 30 and under bar 32. The bars 30 and 32, which are of course fixed, are preferably at an angle between 20° and 25° to the transverse axis of the web W3 before it enters the pair of bars 30 and 32. The bars 30 and 32, as previously mentioned, are parallel. The bars 30 and 32 have been arranged such that the web W3 displaces laterally approximately 3 inches from the web W1. The web W3 passes over the idler roller 17 and overwraps the bar 30, passing over a segment of the bar 30 which is equivalent to a quadrant of the bar. The web W3 then underwraps bar 32 and exits in a plane parallel to the plane of the web W3 at the entry to bar 30. The web W3 then passes over idler rollers 22, 34, and 24.

In an example, the distance between the axes of the bars 30 and 32 was 7.42 inches, while the diameter of each bar was 3.0 inches. The axis of bar 32 was offset downstream from the axis of bar 30 by 2.82 inches. Thus, the angle of the plane of the axes of bars 30 and 32 to the plane of the web W3 entering bar 30 is 112.3°. The portion of the web W3 between bars 30 and 32 is substantially at right angles to the planes of the web W3 entering and exiting the pair of bars 30 and 32. Thus, the web W3 overwraps a quadrant of each of the bars 30 and 32. Since the angle of the axes of the bars to the transverse or lateral axis of the web W3 entering the bars is 23°, the resulting lateral displacement of web section W3 relative to web section W1 is 3 inches.

Figure 5:
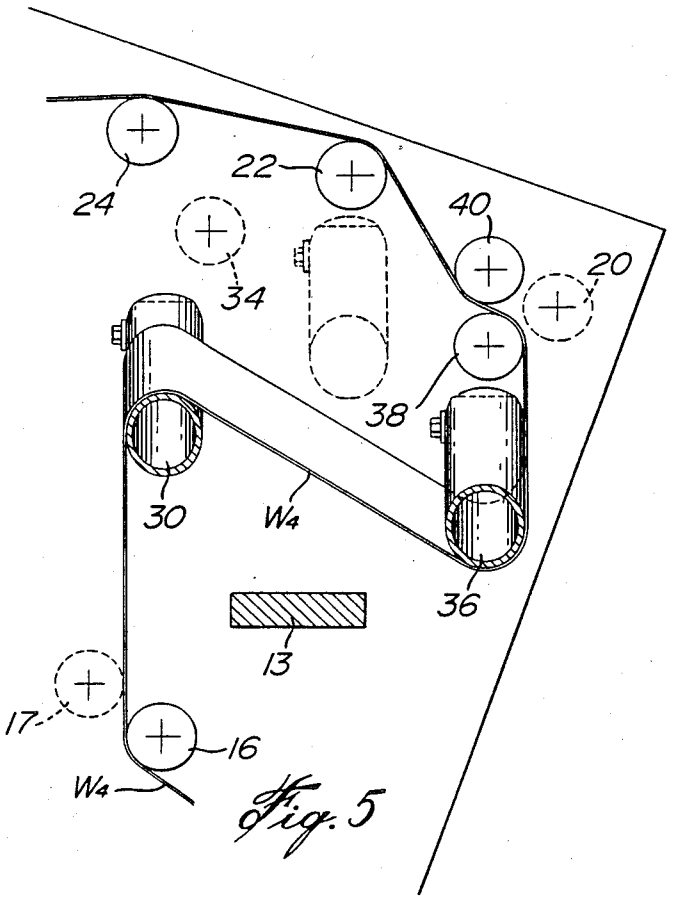
FIG. 5 is a vertical cross-section taken along line 5—5 of FIG. 1.

Web section W4 must be displaced from web section W3 and thus, relative to web section W1, it must be displaced twice the distance. FIG. 5 shows the relative arrangement of the bars, and in particular, bar 30 and bar 36. Although the axes of bars 30 and 36 in the present embodiment are parallel to bar 32, for instance, the arrangement of bars 30 and 36 is such as to provide for the increased displacement required of web W4. In this case, bar 36 is staggered, as shown in FIG. 5, causing web W4 to wrap a larger segment of bars 30 and 36, thereby increasing the angle at which web W4 exits bar 30. Combined with this is the fact that bar 36 is at a greater distance from bar 30, and thus, the path of travel of web W4 at an angled sideways attitude is greater.

Bar 36, which is a hollow tube, is mounted between the side frame 14 and the intermediate subframe member 42 mounted on beam 13. Bar 36 is provided with air jet apertures on the outer surface thereof, particularly in that segment of the bar which will be in contact with the web W4.

In the same example mentioned above in relation to web section W3, bar 30 is merely an extension, and thus it provides the entering bar for both webs W3 and W4. The axis of bar 36, which also had a diameter of 3.0 inches, was parallel and spaced from the axis of bar 30 by 12.37 inches. The bar 36 was offset downstream from the bar 30 by 3.40 inches, and thus the angle between a plane passing through the axes of bars 30 and 36 and the plane of the web W4 entering the bar 30 is 74.0°. Thus, the overwrap of web W4 extends over a greater segment of the bar 30 and bar 36. The result of these characteristics with the angle of the axes of the bars 30 and 36 at 23° to the lateral axis of the web W4 is that the web W4 is displaced from web W3 by a distance of 3 inches. The relative displacement of the web W4 from its original longitudinal path is 6 inches.

Accordingly, web W4 in FIG. 5, which passes over roller 16, overwraps bar 30. The web W4 then underwraps bar 36 and then passes between rollers 38 and 40 to then pass over roller 22 and roller 24 towards the folding mechanism.

Thus, the webs may be displaced as desired by arranging the angle of the bars at an acute angle to the transverse axis of the web or the axis of the press, which taken alone or combined with an adjustment of the distance between the bars and the staggering of the bars to provide for greater or lesser wrap contact on the bar, will empirically provide for the necessary displacement.

We claim:

1. An apparatus for separating a plurality of webs to provide a predetermined distance between the edges of the webs, the apparatus including at least three webs being passed through the apparatus, with a first web passing over roll means, the axes of these roll means being at right angles to the longitudinal axis of the first web, the second and third webs on either side of the first web being displaced by providing pairs of bars in the path of the second and third webs, each of the pairs of bars having their respective axes at an obtuse angle from the longitudinal axis and direction of the first web, and the distance between the bars and the angle of the plane passing through the axis of each bar in a pair to the plane of the web entering the pair of bars being such that the existing second and third webs are distanced laterally from the first web; wherein the factors determining the distance of lateral displacement of the second and third webs relative to the first web is a direct result of said angle of the planes of the axes of each said pair of bars relative to said plane of the web, entering the respective pairs of bars, and a combination of one or more of the diameters of the bars and the distance between the bars.

2. An apparatus as defined in claim 1, wherein the obtuse angle of the respective axes of each pairs of bars is between 160° and 155° from the longitudinal axis and direction of the first web.

3. An apparatus as defined in claim 1, wherein the respective pairs of bars in the path of the second and third webs are symmetrical.

4. An apparatus as defined in claim 1, wherein there are four webs, with a second and third web passing through separate symmetrical pairs of bars on either side of the first web, and a further set of bars being provided adjacent one of the second and third webs for passing the fourth web, whereby the angle of the axes of the pair of bars relative to the fourth web, the distance between the axis of the respective bars in the pair, and the angle of the plane passing through the axes of said pair of bars relative to the plane of the fourth web entering into the bars, is such as to provide a lateral displacement of the fourth web relative to either of the second and third webs.

5. The method of laterally separating a plurality of continuous webs at the adjacent side edges, comprising the steps of:

(a) passing a first web continuously over a first series of roll means;

(b) passing at least a second and third continuous web over a second and third series of rollers and bars respectively, each series including at least a pair of parallel, non-rotating bars;

(c) positioning the non-rotatable bars at an obtuse angle with respect to the axis of the first web;

(d) determining the lateral spacing of the lateral edges of the second and third webs relative to the edges of the first web by one or more factors including selecting the diameters of the bars, the spacing of said bars, and the angle of a plane passing through the axes of the bars in each pair relative to the plane of the web entering the pair of bars.

6. The method as claimed in claim 5, including passing said first web over idler rollers having a longitudinal axis at right angles to said first web, spacing said second and third web on opposite sides of said first web by symmetrically disposed pairs of are disposed in the path of movement of said respective second and third webs, maintaining the axes of the respective pairs of bars from between 155° to 160° from the longitudinal axis of the first web.

7. The method as claimed in claim 6, including separating a fourth web from the first, second and third webs comprising providing a further set of parallel bars adjacent one of the second and third sets of bars, controlling the angle of the axes of the fourth pair of bars to the axis of the fourth web, the angle of the plane passing through the axes of the bars relative to the plane of the fourth web entering the pair of bars, the distance between the axis of the bars, and the diameter of the bars to insure lateral displacement of the fourth web with respect to at least one of the second and third webs.

* * * * *